US008240264B2

(12) United States Patent
Khachaturian

(10) Patent No.: US 8,240,264 B2
(45) **Date of Patent: *Aug. 14, 2012**

(54) MARINE LIFTING APPARATUS

(76) Inventor: Jon Khachaturian, New Orleans, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/028,011

(22) Filed: Feb. 15, 2011

(65) Prior Publication Data

US 2011/0197799 A1 Aug. 18, 2011

Related U.S. Application Data

(63) Continuation of application No. 12/337,305, filed on Dec. 17, 2008, now Pat. No. 7,886,676.

(60) Provisional application No. 61/014,291, filed on Dec. 17, 2007.

(51) Int. Cl.
*B63C 7/00* (2006.01)

(52) U.S. Cl. ..... 114/51

(58) Field of Classification Search ..... 114/44, 114/50, 51; 405/204, 209

See application file for complete search history.

(56) References Cited

U.S. PATENT DOCUMENTS

| | | | |
|---|---|---|---|
| 485,398 | A | 11/1892 | Tyler et al. |
| 3,807,336 | A | 4/1974 | Briggs |
| 4,385,583 | A | 5/1983 | Ayers |
| 4,714,382 | A | 12/1987 | Khachaturian |
| 5,054,415 | A | 10/1991 | Marshall |
| 5,607,260 | A | 3/1997 | Khachaturian |
| 5,609,441 | A | 3/1997 | Khachaturian |
| 5,662,434 | A | 9/1997 | Khachaturian |
| 5,800,093 | A | 9/1998 | Khachaturian |
| 5,836,463 | A | 11/1998 | Khachaturian |
| 5,863,085 | A | 1/1999 | Khachaturian |
| 5,975,807 | A | 11/1999 | Khachaturian |
| 6,000,562 | A | 12/1999 | Khachaturian |
| 6,039,506 | A | 3/2000 | Khachaturian |
| 6,079,760 | A | 6/2000 | Khachaturian |
| 6,149,350 | A | 11/2000 | Khachaturian |
| 6,213,319 | B1 | 4/2001 | Khachaturian |
| 6,296,288 | B1 | 10/2001 | Khachaturian |
| 6,318,931 | B1 | 11/2001 | Khachaturian |
| 6,364,574 | B1 | 4/2002 | Khachaturian |
| 6,367,399 | B1 | 4/2002 | Khachaturian |

(Continued)

FOREIGN PATENT DOCUMENTS

| | | |
|---|---|---|
| KR | 20100008652 | 1/2010 |

(Continued)

*Primary Examiner* — Stephen Avila

(74) *Attorney, Agent, or Firm* — Garvey, Smith, Nehrbass & North, L.L.C.; Charles C. Garvey, Jr.; Vanessa M. D'Souza

(57) ABSTRACT

A catamaran lifting apparatus is disclosed for lifting objects in a marine environment. The apparatus includes first and second vessels that are spaced apart during use. A first frame spans between the vessels. A second frame spans between the vessels. The frames are spaced apart and connected to the vessels in a configuration that spaces the vessels apart. The first frame connects to the first vessel with a universal joint and to the second vessel with a hinged connection. The second frame connects to the second vessel with a universal joint and to the first vessel with a hinged or pinned connection. The catamaran hull arrangement provides longitudinal flexibility in a quartering sea state due to the unique universal joint and hinge placement between the frames or trusses and the hulls or barges.

30 Claims, 8 Drawing Sheets

U.S. PATENT DOCUMENTS

| | | | | |
|---|---|---|---|---|
| 6,412,649 | B1 | 7/2002 | Khachaturian | |
| 6,425,710 | B1 | 7/2002 | Khachaturian | |
| 6,435,773 | B1 | 8/2002 | Khachaturian | |
| 6,435,774 | B1 | 8/2002 | Khachaturian | |
| 6,601,717 | B1 | 8/2003 | Khachaturian | |
| 6,692,190 | B2 | 2/2004 | Khachaturian | |
| 6,719,495 | B2 | 4/2004 | Khachaturian | |
| 7,066,343 | B1 | 6/2006 | Khachaturian | |
| 7,399,018 | B1 | 7/2008 | Khachaturian | |
| 7,527,006 | B2 * | 5/2009 | Khachaturian | 114/50 |
| 7,886,676 | B2 * | 2/2011 | Khachaturian | 114/51 |
| 8,061,289 | B2 * | 11/2011 | Khachaturian | 114/51 |
| 2009/0301372 | A1 | 12/2009 | Khachaturian | |

FOREIGN PATENT DOCUMENTS

| | | |
|---|---|---|
| WO | WO9913164 | 3/1999 |

* cited by examiner

MARINE LIFTING APPARATUS

CROSS-REFERENCE TO RELATED APPLICATIONS

This is a continuation of U.S. patent application Ser. No. 12/337,305, filed Dec. 17, 2008 (issued as U.S. Pat. No. 7,886,676 on 15 Feb. 2011), which is a nonprovisional of U.S. Provisional Patent Application Ser. No. 61/014,291, filed Dec. 17, 2007, each of which is hereby incorporated herein by reference.

Priority of U.S. Provisional Patent Application Ser. No. 61/014,291, filed Dec. 17, 2007, incorporated herein by reference, is hereby claimed.

Incorporated herein by reference are the following:

U.S. patent application Ser. No. 12/760,026, filed Apr. 14, 2010, now abandoned;

U.S. patent application Ser. No. 12/411,948, filed Mar. 26, 2009, now abandoned.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine lifting devices. More particularly, the present invention relates to an improved catamaran type lifting apparatus that employs spaced apart or catamaran hulls, each of the hulls supporting a truss or frame that spans between the hulls at spaced apart positions. Even more particularly, the present invention relates to an improved catamaran lifting apparatus for use in a marine environment, wherein apart frames are connected to the hulls in a configuration that spaces the vessels apart, the first frame connecting with a first of the hulls with the universal joint and to the second hull with a hinged connection, the second frame connecting to the second hull with a universal joint and to the first hull with a hinged connection.

2. General Background of the Invention

A catamaran lifting apparatus that can be used to lift multi-ton objects employs two spaced apart barges or hulls or vessels. In general, such lifting devices that employ a pair of spaced apart hulls have been patented, many patents having been issued to applicant as contained in the following table.

TABLE 1

| PATENT NO. | TITLE | ISSUE DATE (MM-DD-YYYY) |
|---|---|---|
| 4,714,382 | Method and Apparatus for the Offshore Installation of Multi-Ton Prefabricated Deck Packages on Partially Submerged Offshore Jacket Foundations | 12-22-1987 |
| 5,607,260 | Method and Apparatus for the Offshore Installation of Multi-Ton Prefabricated Deck Packages on Partially Submerged Offshore Jacket Foundations | 03-01-1997 |
| 5,609,441 | Method and Apparatus for the Offshore Installation of Multi-Ton Prefabricated Deck Packages on Partially Submerged Offshore Jacket Foundations | 03-11-1997 |
| 5,662,434 | Method and Apparatus for the Offshore Installation of Multi-Ton Prefabricated Deck Packages on Partially Submerged Offshore Jacket Foundations | 09-02-1997 |
| 5,800,093 | Method and Apparatus for the Offshore Installation of Multi-Ton Packages Such as Deck Packages, Jackets, and Sunken Vessels | 09-01-1998 |
| 5,975,807 | Method and Apparatus for the Offshore Installation of Multi-Ton Packages Such as Deck Packages and Jackets | 11-02-1999 |
| 6,039,506 | Method and Apparatus for the Offshore Installation of Multi-Ton Packages Such as Deck Packages and Jackets | 03-21-2000 |
| 6,149,350 | Method and Apparatus for the Offshore Installation of Multi-Ton Packages Such as Deck Packages and Jackets | 11-21-2000 |
| 6,318,931 | Method and Apparatus for the Offshore Installation of Multi-Ton Packages Such as Deck Packages and Jackets | 11-20-2001 |
| 6,364,574 | Method and Apparatus for the Offshore Installation of Multi-Ton Packages Such as Deck Packages and Jackets | 04-02-2002 |

BRIEF SUMMARY OF THE INVENTION

The present invention provides an improved catamaran lifting apparatus that employs first and second spaced apart vessels or hulls. The vessels can be barges, dynamically positioned marine vessels, other floating hulls or the like.

A first frame or truss spans between the hulls at a first position. A second frame or truss spans between the hulls at a second position. The first and second positions are spaced apart so that each frame can move independently of the other, notwithstanding wave action acting upon the hulls.

The first of the frames or trusses connects to the first hull with a universal joint and to the second hull with a hinged connection. The second frame connects to the second hull with a universal joint and to the first hull with a hinged connection. The catamaran hull arrangement provides longitudinal flexibility in a quartering sea state due to the unique universal joint and hinge placement between the frames or trusses and the hulls or barges.

Each frame extends upwardly in a generally inverted u-shape that provides space under the frame and in between the hulls for enabling a marine vessel to be positioned in between the hulls and under the frames. The space in between the hulls and under the frames can also be used as clearance for elevating an object to be salvaged from the seabed to a position next to or above the water's surface.

In a plan view, each frame can be generally triangular in shape. The frames can each be of a truss configuration.

In a second embodiment, one or more slings can be provided that connect between a frame and a hull. The connection of each frame to a hull opposite the universal joint can be a pinned or a hinged connection.

The present invention includes a method of salvaging an underwater object comprising the steps of providing first and second vessels at a locale that is next to an underwater object to be salvaged, mounting a first frame on the vessels that spans between the vessels, mounting a second frame on the vessels that spans between the vessels, connecting the frames to the vessels in a configuration that spaces the vessels apart, connecting the first frame to the first barge with a universal joint and to the second barge with a connection that is not a universal joint, connecting the second frame to the second barge with a universal joint, and to the first barge with a connection that is not a universal joint, providing a space under the frame and in between the vessels, enabling a third marine vessel to be positioned in between the vessels and under the frames, and lifting the object with cabling that extends downwardly from the frames.

Preferably, rigging is connected between each frame and the object to be salvaged, the rigging including slings and hooks.

Preferably, the underwater object to be salvaged is a platform structure having a deck and beams under the deck and further comprising extending rigging through the deck via one or more deck openings and connecting the rigging to beams under the deck.

Preferably, each frame has an upper end portion and the rigging extends between the object to be salvaged and the upper end portions of the frames.

Optionally, mounting a winch and winch cabling on the vessels and frames and further comprising lifting the object to be salvaged with the winch and winch cabling.

Optionally, mounting a winch and winch cabling on the vessels and frames and further comprising lifting the object to be salvaged with the winch and winch cabling, and further comprising attaching rigging that includes a hook suspended from the winch cabling and one or more slings attached to the object to be salvaged and to the hook.

Optionally, the cabling of the step of lifting the object with cabling that extends downwardly from the frames, including more than one lifting line.

Optionally, in the step of lifting the object with cabling that extends downwardly from the frames, the cabling includes multiple winds of cabling rigged to a block and tackle pulley arrangement.

Preferably, spanning one or more beams between the frames and in the step of lifting the object with cabling that extends downwardly from the frames, the cabling depends from the beams.

The invention includes a method of salvaging an underwater object from a seabed area comprising the steps of providing first and second spaced apart hulls, spanning between the hulls with a first arch, spanning between the hulls with a second arch, spacing the arches apart by connecting the hulls together in a configuration that spaces the hulls apart, connecting the first arch to the first hull with a universal joint, connecting the first arch to the second hull with a connection that is not a universal joint, connecting the second arch to the second hull with a universal joint, connecting the second arch to the first hull with a connection that is not a universal joint, extending each arch upwardly in an inverted u-shape, providing a space under the arches and in between the hulls, and lifting the object to be salvaged from the seabed area with rigging fitted to the arches.

Preferably, each arch supports one or more beams and in the step of lifting the object to be salvaged from the seabed area with rigging fitted to the arches, the rigging includes the beams.

Preferably, the rigging includes a pair of beams.

Preferably, the first arch is a truss.

Preferably, the second arch is a truss.

Optionally, the underwater object is a platform having a deck and further comprising one or more slings that connect between the rigging and the platform.

Optionally, the underwater object is a platform having a deck and further comprising one or more slings that connect between the rigging and the platform, and providing a hook as part of the rigging.

Optionally, the underwater object is a platform having a deck and further comprising one or more slings that connect between the rigging and the platform, and providing a hook as part of the rigging, and wherein the sling spans between the hook and the platform and the sling extending through the deck.

Preferably, the first arch is much wider at one end portion than at its other end portion.

Preferably, the second frame is much wider at one end portion than at its other end portion.

The invention includes a method of salvaging an underwater object, comprising the steps of providing a pair of floating hulls, spanning between the hulls with a first frame, spanning between the hulls with a second frame, wherein the frames are spaced apart and connected to the hulls in a configuration that spaces the hulls apart, connecting the first frame to the first hull with a universal joint connection and to the second hull with a connection that is not a universal joint, connecting the second frame to the second hull with a universal joint connection, and to the first hull with a connection that is not a universal joint, extending each frame upwardly and providing a space under the frame and in between the hulls, lifting the object with rigging attached at least in part to the frames, and wherein the connecting of the frames to the hull is with four separate connections.

Preferably, each frame supports one or more beams that are a part of the rigging of the step of lifting the object with rigging attached at least in part to the frames.

Preferably, the rigging includes one or more beams that are connected to the frames.

Preferably, the first frame is a truss.

Preferably, the second frame is a truss.

Preferably, supporting one or more beams with the frames and, in the step of lifting the object with rigging attached at least in part to the frames, the rigging is fitted to the beams.

Optionally, supporting one or more beams with the frames and, in the step of lifting the object with rigging attached at least in part to the frames, the rigging is fitted to the beams, and suspending a crown block from the beams as part of the rigging.

Optionally, supporting one or more beams with the frames and, in the step of lifting the object with rigging attached at least in part to the frames, the rigging is fitted to the beams, and suspending a hook from the beams as part of the rigging.

Preferably, the first frame is much wider at one end portion than at its other end portion.

Preferably, the second frame is much wider at one end portion than at its other end portion.

Preferably, each frame has end portions, one end portion being wider than the other at a position where the frame end portions connect to a hull.

Preferably, each frame is generally arch shaped.

The invention includes a method of raising a submerged object from a seabed area in a marine locale comprising the steps of transporting a floating support structure to the marine locale that includes spaced apart deck areas with an open space therebetween, connecting a pair of arches to the floating support structure with connections that include multiple universal joints and multiple connections that are not universal joints, and wherein one universal joint is on one deck area and supports a first of said arches and the other universal joint is on a second deck area and supports a second of said arches, lifting the submerged object from the seabed area with rigging that is supported by the floating support structure and arches, and wherein the object lifted is lifted to the open space.

Preferably, the floating support structure includes a catamaran.

Optionally, including using multiple hulls to transport the floating support structure, said hulls being a part of the support structure.

Optionally, including using multiple vessels to transport the floating support structure, said vessels being a part of the support structure.

Optionally, each arch has a wide end portion and a narrow end portion, and further comprising the step of connecting the narrow end of each arch to the floating support structure with a universal joint.

Optionally, each arch has a wide end portion and a narrow end portion, and further comprising the step of connecting the wide end of each arch to the floating support structure with a hinge.

Optionally, each arch has a wide end portion and a narrow end portion, and further comprising the step of connecting the narrow end of each arch to the floating support structure with a universal joint, and further comprising the step of connecting the wide end of each arch to the floating support structure with a hinge.

Preferably, the floating structure is a catamaran and further comprising the step of connecting a pair of arches to the floating support structure with connections that include multiple universal joints and multiple connections that are not universal joints, and wherein one universal joint is on one deck area and supports a first of said arches and the other universal joint is on a second deck area and supports a second of said arches, being completed before the completion of the step of transporting a floating support structure to the marine locale that includes spaced apart deck areas with an open space therebetween.

Preferably, the step of connecting a pair of arches to the floating support structure with connections that include multiple universal joints and multiple connections that are not universal joints, and wherein one universal joint is on one deck area and supports a first of said arches and the other universal joint is on a second deck area and supports a second of said arches, is completed before the step of transporting a floating support structure to the marine locale that includes spaced apart deck areas with an open space therebetween.

Preferably, the rigging includes one or more beams that span between the arches and further comprising suspending a crown block from the beam or beams.

Optionally, at least one of the winches is mounted on a vessel.

Optionally, at least one of the winches is mounted on a frame.

Optionally, the rigging in the step of lifting the object to be salvaged from the seabed area with rigging fitted to the arches includes a winch mounted on a said deck and a winch cable rigged to the winch and to a said frame.

Optionally, the rigging in the step of lifting the object to be salvaged from the seabed area with rigging fitted to the arches includes a winch mounted on a said frame and a winch cable rigged to the winch and to a said frame.

Optionally, the rigging in the step of lifting the object with rigging attached at least in part to the frames includes a winch mounted on a said deck and a winch cable rigged to the winch and to a said frame.

Optionally, the rigging in the step of lifting the object with rigging attached at least in part to the frames includes a winch mounted on a said frame and a winch cable rigged to the winch and to a said frame.

Optionally, the rigging in the step of lifting the submerged object from the seabed area with rigging that is supported by the floating support structure and arches includes a winch mounted on a said deck and a winch cable rigged to the winch and to a said frame.

Optionally, the rigging in the step of lifting the submerged object from the seabed area with rigging that is supported by the floating support structure and arches includes a winch mounted on a said frame and a winch cable rigged to the winch and to a said frame.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
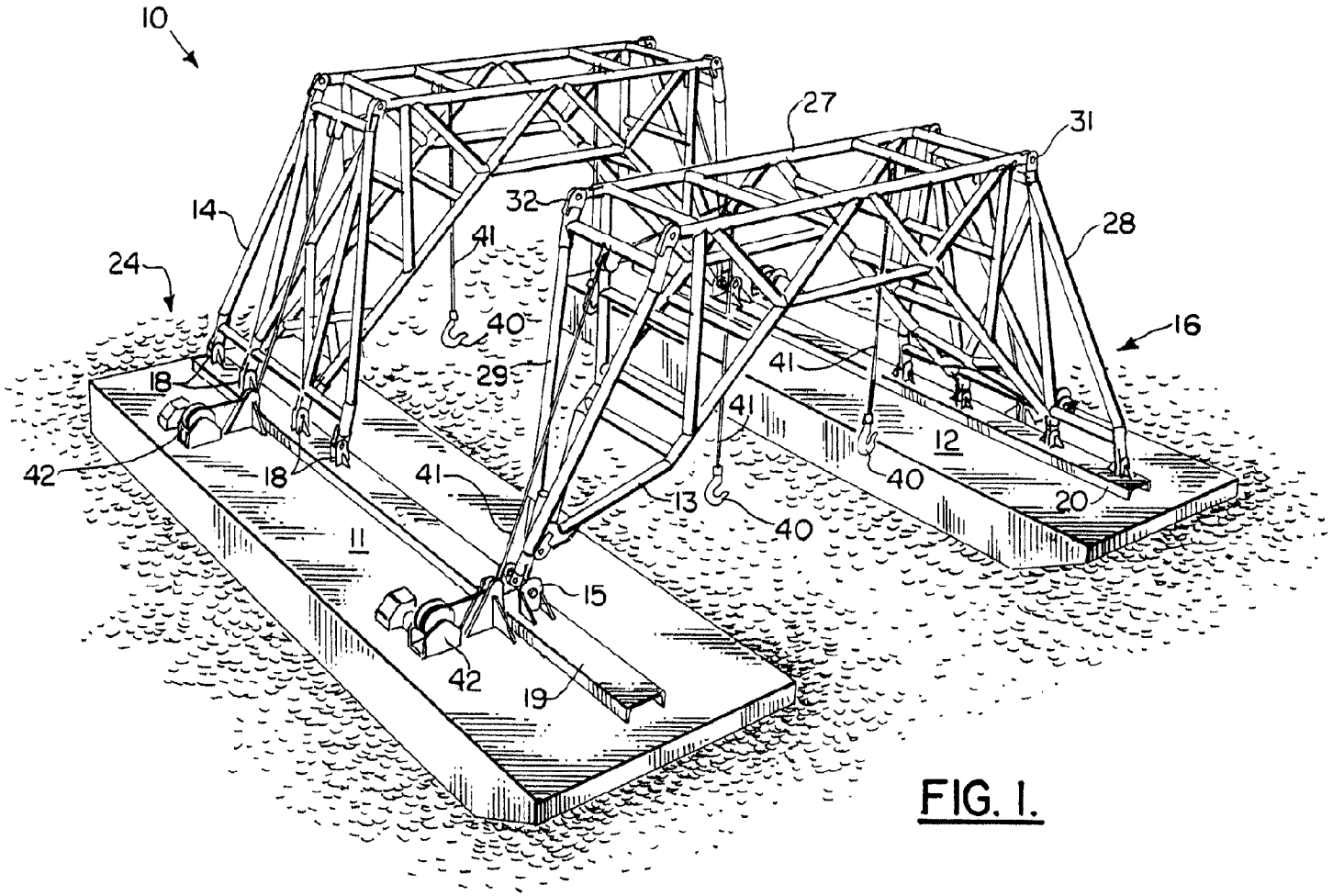
FIG. 1 is a perspective view of the preferred embodiment of the apparatus of the present invention.
Figure 2:
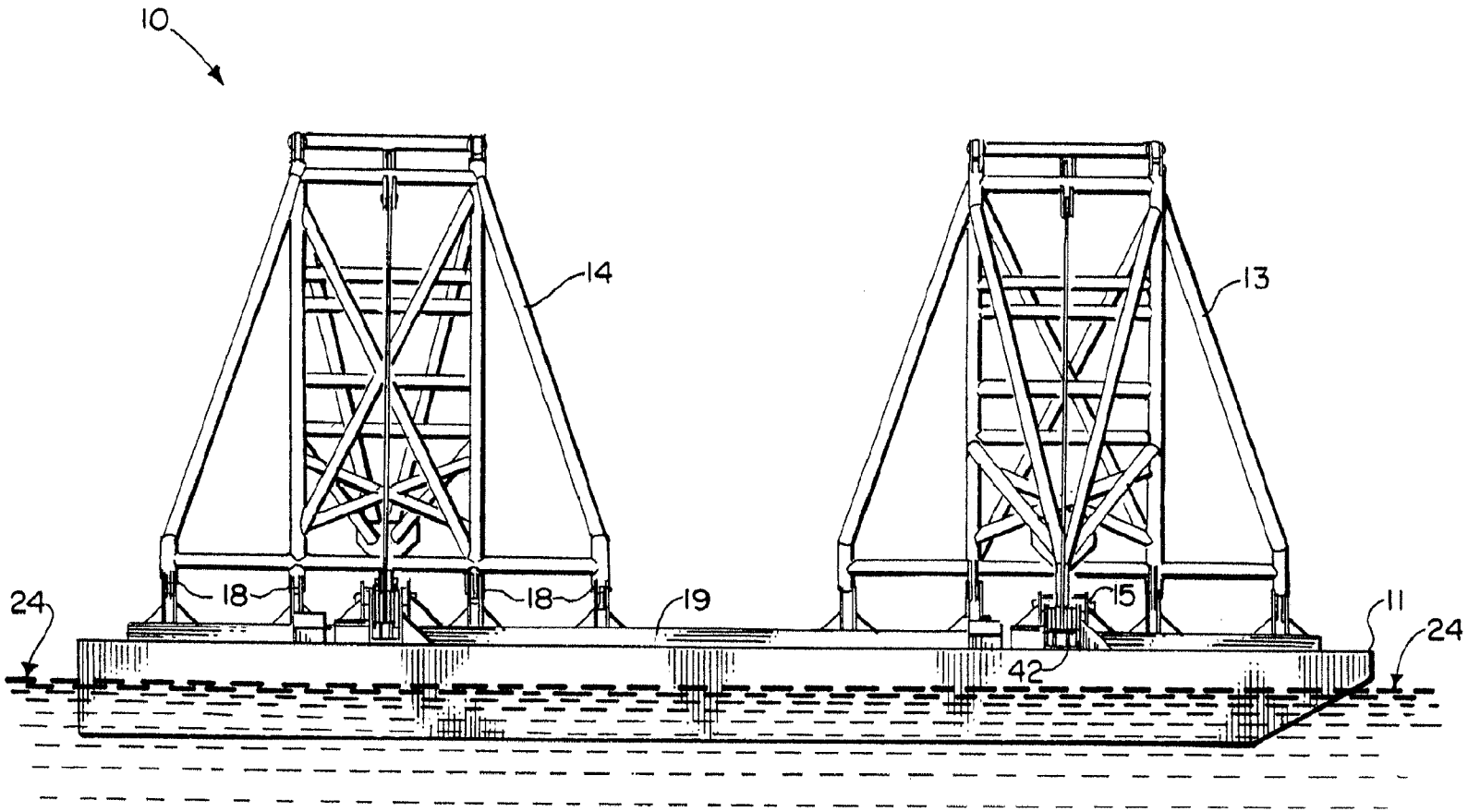
FIG. 2 is an elevation view of the preferred embodiment of the apparatus of the present invention.

FIG. 1 shows the preferred embodiment of the apparatus of the present invention designated generally by the numeral 10. Marine lifting apparatus 10 provides a pair of spaced apart vessels or hulls 11, 12. Hulls 11, 12 can be barges, dynamically positioned vessels (see FIGS. 6-8), or any other buoyant structure. A pair of frames 13, 14 are provided, each frame 13, 14 spanning between the vessels 11, 12. Each frame 13, 14 connects to one vessel 11 or 12 with a universal joint 15 and to the other hull 11 or 12 with a hinged or pinned connection 16.

The frame 13 connects to hull 11 with universal joint 15. The frame 13 connects to vessel 12 with pinned connection or hinge 16. Similarly, the second frame 14 connects to hull 12 with a universal joint 17 and to hull 11 with a hinge or pinned connection 18.

An interface such as a deck beam can be provided on the upper deck 30 of each hull 11, 12 for forming an interface between the frames 13, 14 and the vessels 11, 12. For example, vessel 11 is provided with deck beam 19 that forms an interface between each of the frames 13, 14 and the barge or vessel 11. Deck beam 20 provides an interface between each of the frames 13, 14 and the vessel or barge 12.

Figure 3:
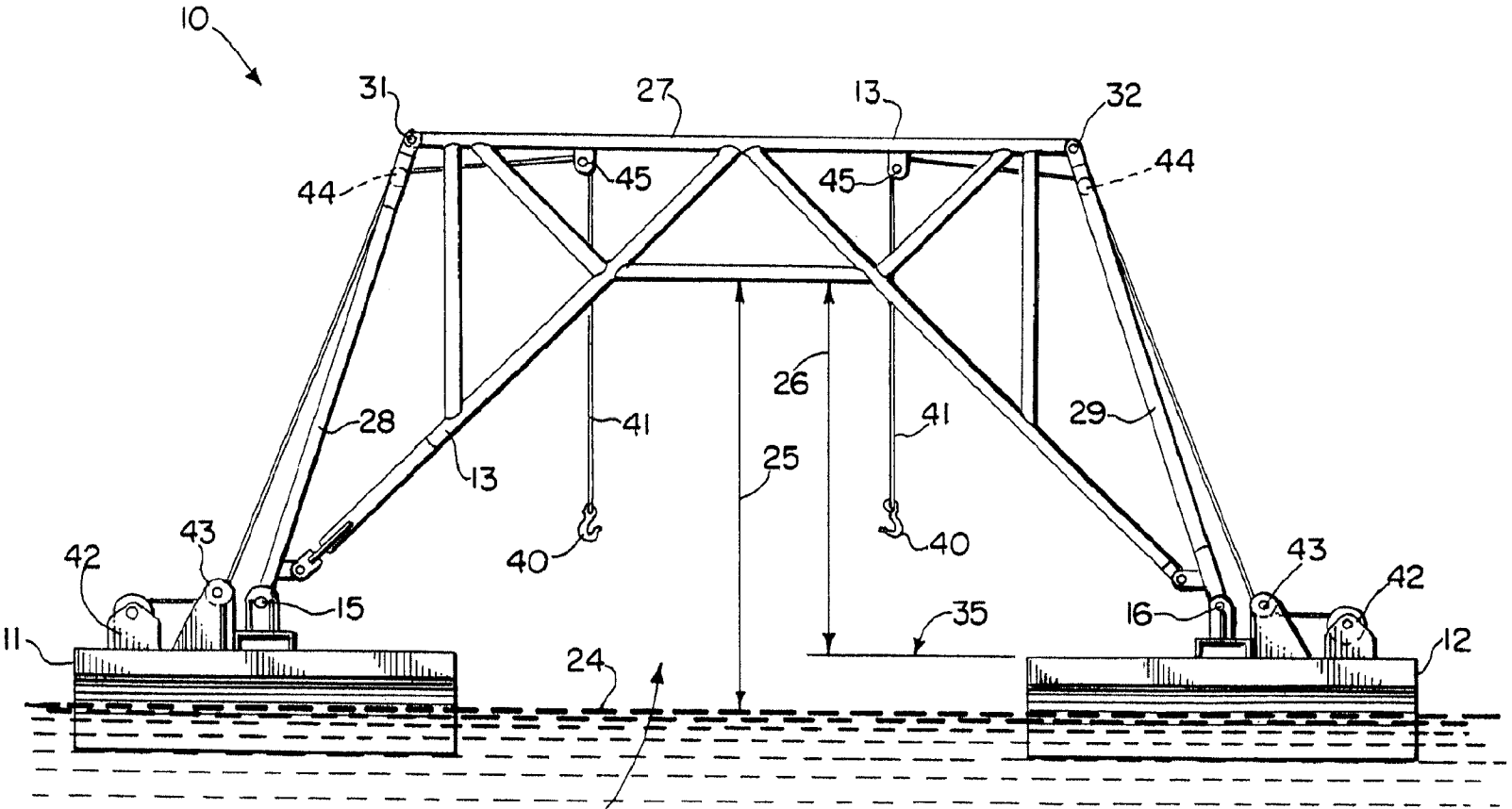
FIG. 3 is an end, elevation view of the preferred embodiment of the apparatus of the present invention.
Figure 4:
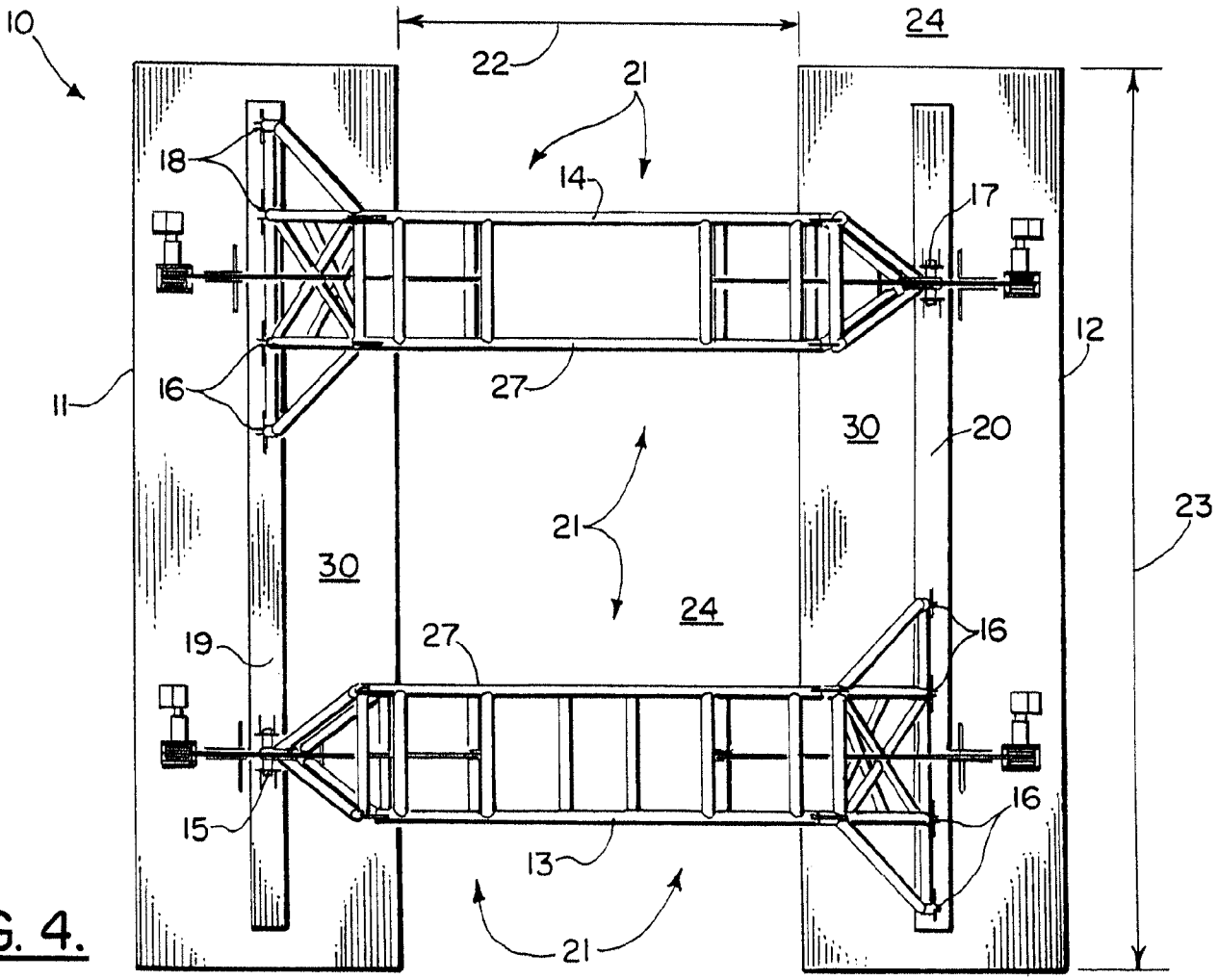
FIG. 4 is a top plan view of the preferred embodiment of the apparatus of the present invention, with each winch and lifting line removed for clarity.
Figure 5:
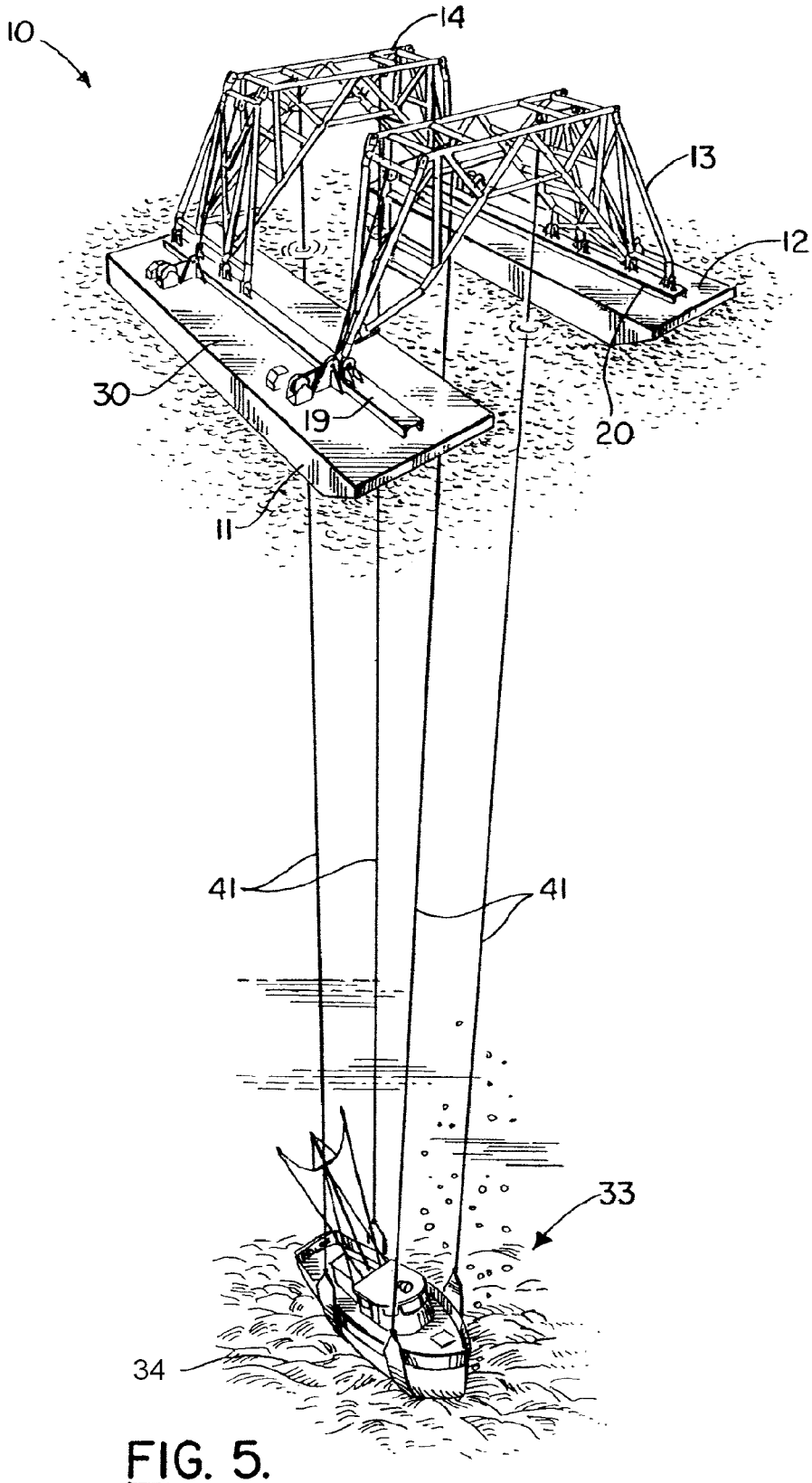
FIG. 5 is a perspective view of the preferred embodiment of the apparatus of the present invention.

In FIGS. 1 and 3, a plan or top view of the apparatus 10 of the present invention is shown with each winch and lifting line removed for clarity. A lifting area 21 is that area that is in between the vessels 11, 12, the area 21 having a length defined by dimension arrow 23 and a width defined by dimension arrow 22 in FIG. 4. This area 21 is sized and shaped to receive a vessel having a cargo to be lifted if that cargo (e.g. deck package) is to be installed. Alternatively, the area 21 can be an area that receives an item to be salvaged from an ocean floor such as a sunken boat or the like. In either case, a clearance is provided above the water surface 24 so that a barge or vessel can be placed under frames 13, 14 to receive the item (e.g., boat 33) that is salvaged from seabed 34.

In FIG. 3, a clearance is indicated schematically by the dimension line 25. Similarly, a clearance 26 is provided above the maximum deck elevation 35 of the hulls 11, 12 as shown in FIG. 3.

Each of the frames 13, 14 can be in the form of a truss as shown. Each frame 13, 14 can thus provide a center truss section 27, a smaller side truss section 28 and another smaller side truss section 29. Pinned connections 31, 32 can be provided for attaching the smaller truss sections 28, 29 to the larger center truss section 27 as shown in FIG. 3. For the frame of FIGS. 2-5, slings (not shown) can optionally be provided for connecting the center section 27 to the lower end portion of each of the smaller truss sections 28, 29. Shackles can be used to attach any slings to eyelets or padeyes on the center section 27. Likewise, shackles can be used to attach the slings to eyelets or padeyes or other attachments on the smaller truss sections 28, 29.

One or more hooks 40 or other lifting fitting can be attached to a lifting line 41 and payed out from winch 42. Sheaves 43, 44, 45 as needed can be used to route the line 41 from winch 42 to hook 40. Line 41 can be a multiple line assembly to increase lift capacity. Hook 40 can be any lifting fitting such as any known crown block, for example.

Figure 6:
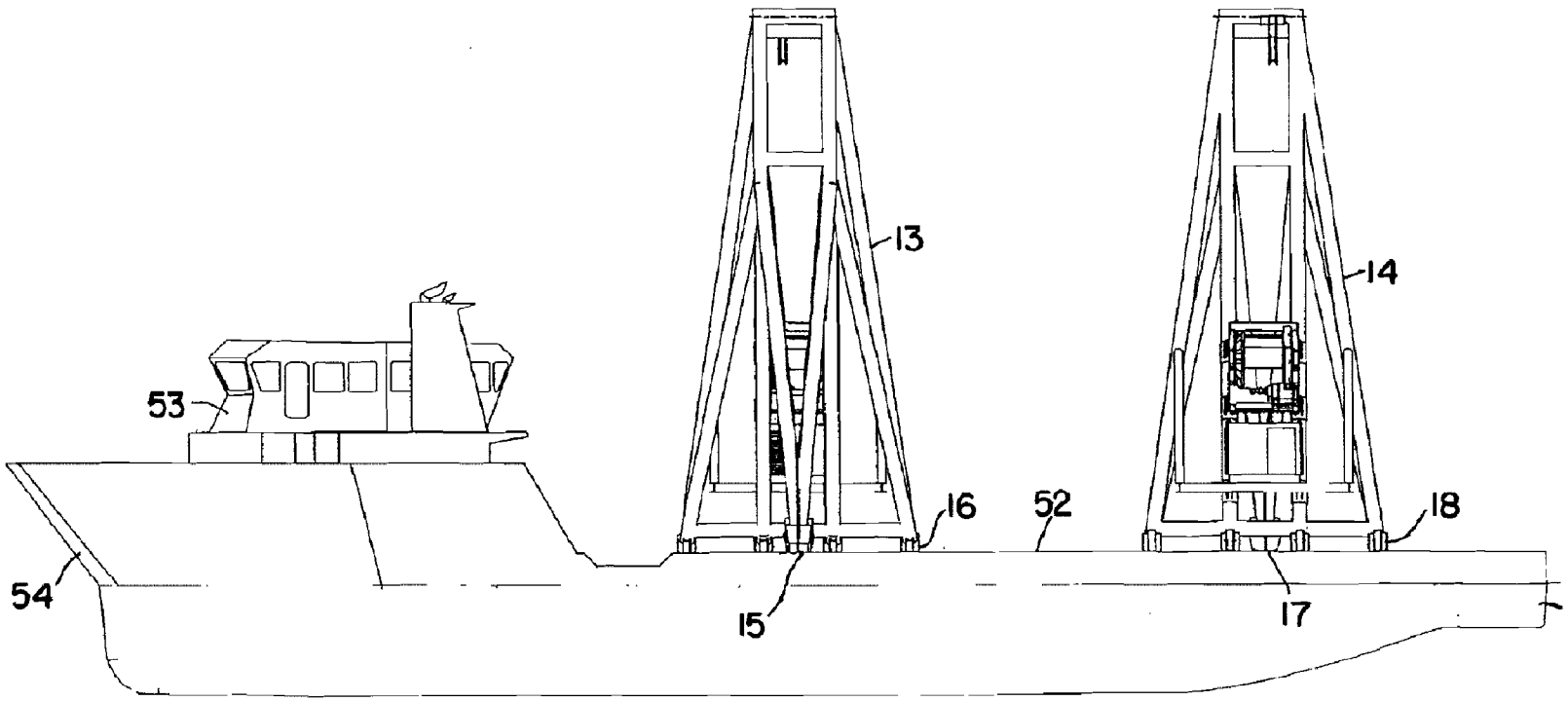
FIG. 6 is an elevation view of the preferred embodiment of the apparatus of the present invention wherein the hulls are dynamically positioned vessels.
Figure 7:
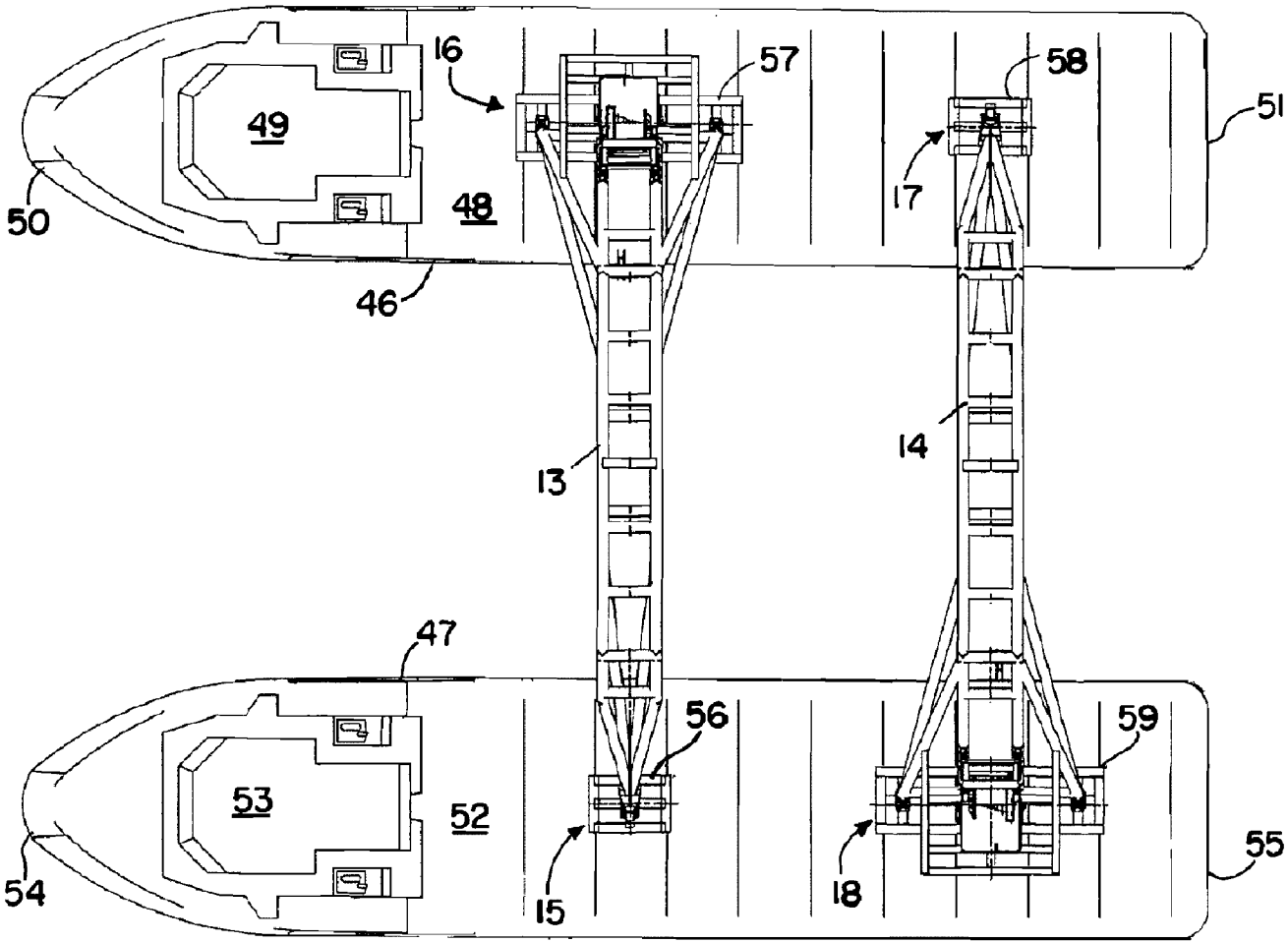
FIG. 7 is a plan view of the preferred embodiment of the apparatus of the present invention wherein the hulls are dynamically positioned vessels.
Figure 8:
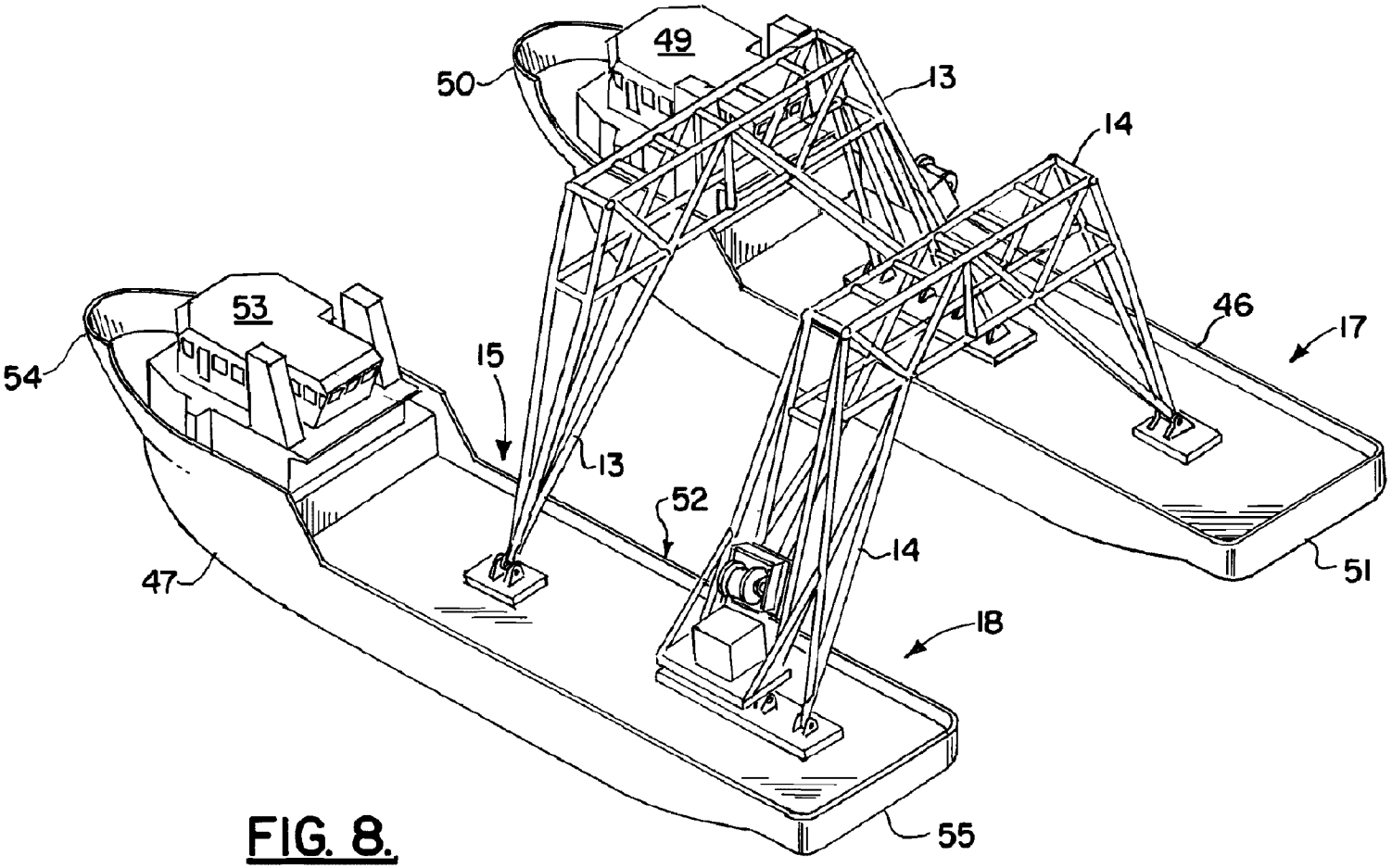
FIG. 8 is a perspective view of the preferred embodiment of the apparatus of the present invention wherein the hulls are dynamically positioned vessels.

FIGS. 6-8 illustrate that dynamically positioned vessels 46, 47 can be used to support frames 13, 14. Dynamically positioned vessels 46, 47 are commercially available and are known. Dynamic positioning systems for vessels are commercially available. An example is the Kongsberg Simrad SBP10 work station. Such vessels 46, 47 can maintain a position even without the use of anchors. Dynamic positioning is a computer controlled system to automatically maintain a vessels position and heading by using the vessels own propellers and/or thrusters. Position reference sensors, combined with wind sensors, motion sensors and gyro compasses provide information to the computer pertaining to the vessels position and the magnitude and direction of the environmental forces affecting its position. Typically, a computer program contains a mathematical model of the vessel that includes information pertaining to wind and current drag of the vessel and the location of the thrusters. This knowledge, combined with the sensor information allows the computer to calculate the required steering angle and/or thruster output for each thruster. This allows operations at sea while mooring or anchoring is not feasible due to deep water, congestion on the sea bottom (pipelines, templates) or other problems.

Dynamic positioning may either be absolute in that the position is locked to a fixed point over the bottom, or relative to a moving object like another ship or an underwater vehicle. One may also position the ship at a favorable angle towards the wind, waves and current, called weathervaning. Dynamic position is much used in the offshore oil industry. There are more than 1,000 dynamic positioning ships in existence.

In FIGS. 6-8, dynamically positioned vessels 46, 47 each have a deck, pilot house or cabin, bow and stern. The dynamically positioned vessel 46 provides deck 48, pilot house 49, bow 50 and stern 51. Dynamically positioned vessel 47 provides a deck 52, pilot house 53, bow 54, stern 55.

Load spreader platforms can be provided to define an interface between each of the frames 13, 14 and the dynamically positioned vessels 46, 47. Load spreader platform 56 is positioned under articulating connection 15 while load spreader platform 57 is positioned under hinge or pinned connection 16. Load spreader platform 58 is positioned under articulating connection 17, forming an interface between that connection 17 and the deck 48 of vessel 46. Similarly, load spreader platform 59 forms an interface between deck 52 of vessel 47 and hinged or pinned connection 18 as shown in FIGS. 5-8.

In the preferred embodiment, the frames 13, 14 are positioned in between the pilot house of each dynamically positioned vessel and the stern of each dynamically positioned vessel as shown in FIG. 7. In the preferred embodiment, the dynamically positioned vessels 46, 47 are positioned so that both vessels 46, 47 have the bow 50, 54 pointed in the same direction and the stern 51, 55 pointed in the same direction, as shown in FIGS. 7-8.

As with the preferred embodiment of FIGS. 1-5, each frame 13, 14 can be provided with a winch 42 and multiple sheaths 43-45 and lifting line 41 with hook 40 and any other suitable rigging that enables the frames 13, 14 to lift objects from the seabed or to support items in between the dynamically positioned vessels 46, 47 in load area 60 and under frames 13, 14.

The following is a list of parts and materials suitable for use in the present invention.

PARTS LIST

| Part Number | Description |
|---|---|
| 10 | marine lifting apparatus |
| 11 | vessel |
| 12 | vessel |
| 13 | frame |
| 14 | frame |
| 15 | universal joint |
| 16 | hinge |
| 17 | universal joint |
| 18 | hinge |
| 19 | deck beam/interface |
| 20 | deck beam/interface |
| 21 | area |
| 22 | dimension |
| 23 | dimension |
| 24 | water surface |
| 25 | clearance above water |
| 26 | clearance above hull deck |
| 27 | center truss section |
| 28 | smaller truss section |
| 29 | smaller truss section |
| 30 | hull deck |
| 31 | pinned connection |
| 32 | pinned connection |

-continued

PARTS LIST

| Part Number | Description |
|---|---|
| 33 | sunken boat |
| 34 | seabed |
| 35 | maximum deck elevation |
| 40 | lifting hook |
| 41 | lifting line |
| 42 | winch |
| 43 | sheave |
| 44 | sheave |
| 45 | sheave |
| 46 | dynamically positioned vessel |
| 47 | dynamically positioned vessel |
| 48 | deck |
| 49 | pilot house |
| 50 | bow |
| 51 | stern |
| 52 | deck |
| 53 | pilot house |
| 54 | bow |
| 55 | stern |
| 56 | load spreader platform |
| 57 | load spreader platform |
| 58 | load spreader platform |
| 59 | load spreader platform |
| 60 | load area |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of lifting a package in a marine environment, comprising the steps of:

a) providing spaced apart first and second vessels having a space therebetween each vessel being a self-propelled vessel with a bow and a stern, the bows of each vessel being pointed generally in the same direction;

b) spanning a first frame between the vessels;

c) spanning a second frame between the vessels;

d) spacing the frames apart and connecting the frames to the vessels in a configuration that maintains said spacing of the vessels apart;

e) connecting the first frame to the first vessel with a universal joint and to the second vessel with a hinged connection;

f) connecting the second frame to the second vessel with a universal joint, and to the first vessel with a hinged connection;

g) wherein the universal joint and the hinged connection on the first vessel are spaced apart;

h) wherein the universal joint and the hinged connection on the second vessel are spaced apart; and i) extending each frame upwardly to provide a space under the frame and in between the vessels, enabling a package that is to be lifted to be positioned in between the vessels and under the frames.

2. The method of claim 1 wherein at least one vessel is dynamically positioned.

3. The method of claim 1 wherein each vessel is dynamically positioned.

4. The method of claim 1 wherein the first frame includes a truss.

5. The method of claim 1 wherein the second frame includes a truss.

6. The method of claim 1 further comprising the step of controlling the position of each vessel with an electronic positioning device.

7. The method of claim 1 further comprising the step of controlling the position of each vessel with a computer.

8. The method of claim 1 wherein in step "e" the hinged connection includes multiple pinned connections.

9. The method of claim 1 further comprising the step of extending the first frame much wider at one end portion than at its other end portion.

10. The method of claim 1 further comprising the step of extending the second frame much wider at one end portion than at its other end portion.

11. A catamaran vessel lifting apparatus comprising:

a) first and second vessels, at least one of the vessels being a dynamically positioned vessel;

b) a first frame that spans between the vessels;

c) a second frame that spans between the vessels;

d) the frames being spaced apart and being connected to the vessels in a configuration that spaces the vessels apart;

e) the first frame connecting to the first vessel with a first universal joint and to the second vessel with a first hinged connection, wherein the first universal joint and first hinged connection are spaced apart;

f) the second frame connecting to the second vessel with a second universal joint, and to the first vessel with a second hinged connection, wherein the second universal joint and the second hinged connection are spaced apart; and g) providing a space under a said frame and in between the vessels, said space enabling a load to be supported by the frames.

12. The catamaran vessel lifting apparatus of claim 11 wherein each hinged connection is not a universal joint.

13. The catamaran vessel lifting apparatus of claim 11 wherein each universal joint is an articulating joint that enables rotation about multiple axes.

14. The catamaran vessel lifting apparatus of claim 11 wherein the first frame includes a truss.

15. The catamaran vessel lifting apparatus of claim 11 wherein the second frame includes a truss.

16. The catamaran vessel lifting apparatus of claim 11 wherein a said hinged connection includes multiple pinned connections.

17. The catamaran vessel lifting apparatus of claim 11 wherein the first frame is much wider at one end portion than at its other end portion.

18. The catamaran vessel lifting apparatus of claim 11 wherein the second frame is much wider at one end portion than at its other end portion.

19. The catamaran vessel lifting apparatus of claim 11 wherein both vessels are dynamically positioned vessels.

20. The catamaran vessel lifting apparatus of claim 11 wherein each vessel has a bow, a stern and wherein the bows of the vessels are pointed in the same direction.

21. A catamaran vessel lifting apparatus comprising:

a) first and second vessels, at least one of the vessels being a dynamically positioned vessel;

b) a first frame that spans between the vessels;

c) a second frame that spans between the vessels;

d) the frames being spaced apart and being connected to the vessels in a configuration that spaces the vessels apart;

e) the first frame connecting to the first vessel with a universal joint and to the second vessel with a hinged connection;

f) the second frame connecting to the second vessel with a universal joint, and to the first vessel with a hinged connection; and g) each frame extending upwardly in an inverted u-shape, providing a space under the frame and in between the vessels;

h) wherein at least one of said vessels has a pilot house, a deck, a bow and a stern and wherein each of the frames attaches to the vessel in between a pilot house and a stern.

22. The catamaran vessel lifting apparatus of claim 21 wherein each hinged connection is not a universal joint.

23. The catamaran vessel lifting apparatus of claim 21 wherein each universal joint is an articulating joint that enables rotation about multiple axes.

24. The catamaran vessel lifting apparatus of claim 21 wherein the first frame includes a truss.

25. The catamaran vessel lifting apparatus of claim 21 wherein the second frame includes a truss.

26. The catamaran vessel lifting apparatus of claim 21 wherein the hinge includes multiple pinned connections.

27. The catamaran vessel lifting apparatus of claim 21 wherein the first frame is much wider at one end portion than at its other end portion.

28. The catamaran vessel lifting apparatus of claim 21 wherein the second frame is much wider at one end portion than at its other end portion.

29. The catamaran vessel lifting apparatus of claim 21 wherein both vessels are dynamically positioned vessels.

30. The catamaran vessel lifting apparatus of claim 21 wherein each vessel has a bow, a stern and wherein the bows of the vessels are pointed in the same direction.

* * * * *